US006601242B1

(12) United States Patent
Rebischke

(10) Patent No.: US 6,601,242 B1
(45) Date of Patent: Aug. 5, 2003

(54) FLEXIBLE SINK STRAINER AND STOPPER

(76) Inventor: Gary H. Rebischke, 843 SE. 37th St., Buffalo, MN (US) 55313

( * ) Notice: Subject to any disclaimer, the term of this patent is extended or adjusted under 35 U.S.C. 154(b) by 0 days.

(21) Appl. No.: 09/695,528

(22) Filed: Oct. 24, 2000

(51) Int. Cl.[7] ..... A47K 1/14

(52) U.S. Cl. ..... 4/286; 4/287; 4/292; 4/293; 4/DIG. 14

(58) Field of Search ..... 4/286, 287, 288, 4/290, 292, 293, 295, DIG. 14, 241

(56) References Cited

U.S. PATENT DOCUMENTS

| | | | | |
|---|---|---|---|---|
| 171,002 | A | * | 12/1875 | Donovan |
| 247,273 | A | * | 9/1881 | Ricketts |
| 1,956,654 | A | * | 5/1934 | Pope |
| 2,169,896 | A | * | 8/1939 | Gazey |
| 2,188,613 | A | * | 1/1940 | Reedy |
| 2,450,393 | A | * | 9/1948 | Donahue |
| 2,793,373 | A | * | 5/1957 | Ewing |
| 2,875,958 | A | * | 3/1959 | Wieczorek |
| 3,010,120 | A | * | 11/1961 | Young |
| 3,800,339 | A | * | 4/1974 | Bergin |
| 4,143,432 | A | * | 3/1979 | Deken ..... 4/295 |
| 4,752,035 | A | * | 6/1988 | Felder ..... 4/287 |
| 5,265,281 | A | * | 11/1993 | McAlpine |
| 5,271,108 | A | * | 12/1993 | Wicke |

FOREIGN PATENT DOCUMENTS

| | | | |
|---|---|---|---|
| GB | 2165146 A | * | 4/1986 |
| GB | 2211729 A | * | 7/1989 |

* cited by examiner

*Primary Examiner*—Gregory Huson
*Assistant Examiner*—Khoa Huynh
(74) *Attorney, Agent, or Firm*—Vidas, Arrett & Steinkraus, P.A.

(57) ABSTRACT

A combination flexible strainer and plug for use in conjunction with a drain opening of a plumbing fixture. The strainer comprising a substantially cylindrical portion constructed and arranged to extendingly engage the drain opening. The strainer having a bottom portion engaged to a lowermost portion of the substantially cylindrical portion, the bottom portion having a plurality of openings therethrough. The strainer having an annular ring engaged to an uppermost portion of the substantially cylindrical portion and outwardly extending therefrom, the annular ring constructed and arranged to form a seal with a portion of the plumbing fixture immediately adjacent to the drain opening. The plug comprising an upper surface, the upper surface and a lower surface. The upper surface having at least one projection, the at least one projection providing a grasping surface by which the plug may inserted into and removed from within the substantially cylindrically shaped portion. A lower surface, the lower surface constructed and arranged to be removably engage the bottom portion of the strainer, the lower surface forming a water tight seal over the plurality of openings when the plug is engaged to the bottom portion.

15 Claims, 5 Drawing Sheets

FLEXIBLE SINK STRAINER AND STOPPER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates to drain strainers and stoppers. More particularly the present invention is directed to a combination flexible drain strainer and stopper which may be inserted into a drain opening and utilized to collect particulate matter while provide a plumbing fixture, such as a kitchen sink, with one or more drainage rates. The present invention is also directed to drain strainer capable of completely stopping drainage as desired.

2. Description of the Related Art

Strainers for use in sinks and other plumbing fixtures are common place in many homes and businesses. Such strainers are typically found in sinks, tubs, and other fixtures where they are utilized to prevent particulate matter such as food, hair and other potentially plumbing unfriendly items form passing out of the fixture and down the drain.

Most strainers are somewhat permanently affixed above or within the drain opening of a plumbing fixture. While many strainers may be removed from the drain, removal may require that the strainer be pried out using a screw driver or other tool, or otherwise be removed with some difficulty. Where a sink includes a recessed or built in strainer, supplemental strainers have been developed to prevent particulate accumulation on such built in strainers, as such build up may accumulate and impede water flow.

An example of such a supplemental strainer is shown in U.S. Pat. No. 4,134,162 wherein a supplemental and disposable strainer is shown which has a conical straining surface which is secured over the drain opening and which projects upwardly above the bottom of the sink. While such a strainer is easily removed from the drain opening, the inherent shape, of the strainer makes it difficult to collect and dispose of particulate which may have accumulated thereabout. In addition, the strainer described in U.S. Pat. No. 4,134,162 does not disclose a means for adjusting the flow rate through the strainer or provide a plug which could be used to readily stop drainage through the strainer.

While many sinks do not have a built in strainer within or over there drain openings. However, there are examples of upwardly projecting strainers for use with such drains. For example in U.S. Pat. No. 5,724,684 to Paar describes a raised strainer having a threaded region with a straining region mounted thereon. In Paar the threaded region may be threaded into a drain opening to allow the straining region to protrude upward into a sink. Paar also indicates that the use of a putty such as plumber's putty is needed to provide a water tight seal between the straining region and the sink surface. Again such a strainer does not provide for ready cessation of drain flow and does not provide for the ability to easily remove particulate which may accumulate thereon.

Some other strainers have been developed which may be inserted into a drain basket so as to provide a removable strainer which may collect particulate therein. For example U.S. Pat. No. 3,982,289 to Robbins describes a disposable sink strainer which is shaped to fit complimentarily into a conventional sink strainer. While the Robbins sink strainer may easily be removed so as to dispose of particles which have accumulated therein, Robbins does not provide a strainer having more than one flow rate, or a means of stopping flow as is desired.

BRIEF SUMMARY OF THE INVENTION

The present invention provides for a drain strainer that is removably securable to the bottom of a plumbing fixture, such as a sink, and which is constructed and arranged so as to encircle the drain opening therein. The present invention provides a fixture with a strainer capable of straining particulate matter out of a fluid flowing therethrough and which may be removed for cleaning and easy disposal of the particulate accumulated therein. As indicated, the present strainer may be provided with unique plug assembly which may be used to partially restrict the flow of fluid therethrough and which may be adjusted within the strainer to prevent flow altogether.

The present invention is made of a flexible material or materials such as rubber, polymer and/or polymer-like materials. The present strainer and plug are of relatively low cost and may easily be replaced if needed. In addition, the present strainer and plug may be installed and removed from a drain opening without the use of tools or sealants.

In light of the above, the present invention provides for a low cost sink strainer and an optional plug which may be inserted into a drain opening of any open plumbing fixture.

In at least one embodiment of the invention, the strainer may include an annular ring which provides the strainer with the ability to be self supporting within an open drain and form a seal around the drain to ensure that water flows through the strainer surface. Additionally, the annular ring provides for improved strainer capacity.

In at least one embodiment of the invention, the strainer may be utilized in conjunction with a plug to restrict or prevent water flow.

In at least one embodiment of the invention, the material is flexible and resistant to cutting, tearing, scratching and heat.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
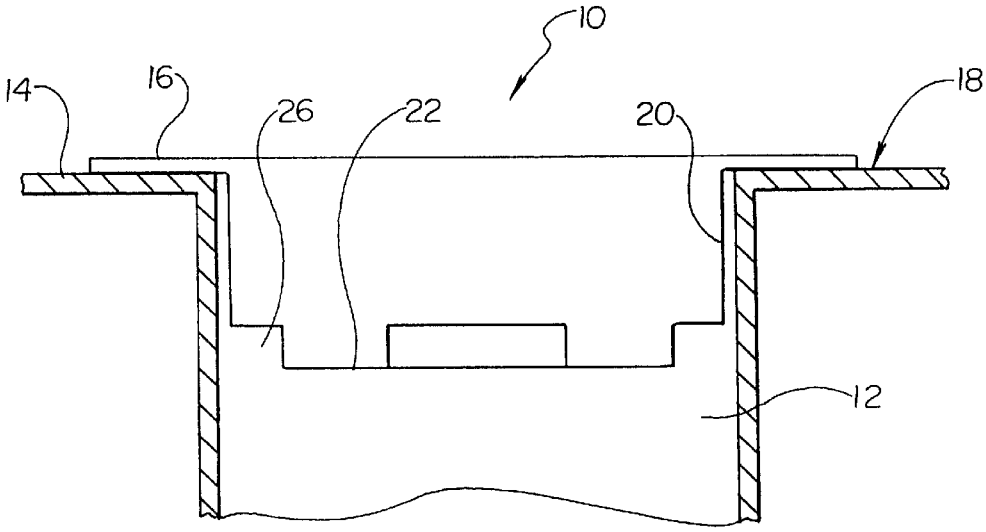
FIG. 1 is a side view of an embodiment of the strainer as may be seen when placed in a drain opening.

As may be seen in FIG. 1, the present invention is directed to a strainer 10 which may be placed into a drain 12 of a fixture 14, such as a sink, tub, etc. The strainer 10 includes an annular ring 16 which engages the fixture surface 18 immediately surrounding the drain 12. The ring 16 forms a seal with the surface 18 to ensure that most or all of the water or fluid placed in the fixture 14 is directed through the strainer 10.

Where there is no interfering structure in the drain 12, such as a grate or built in strain basket (not shown) the annular ring 16 may support the weight of the strainer 10 within the drain 12.

As drains typically have circular openings, the present strainer 10 is preferably substantially cylindrical in shape so that the strainer may be inserted into the drain 12 in the manner shown. However, as may be seen, the diameter of the strainer 10 may be optionally provided with a somewhat conical shape, tapering from a first diameter at the ring 16 to a second diameter at the bottom surface 22 in the manner shown. It should also be noted, that the present strainer 10 may be manufactured into any shape and/or size to accommodate nearly any drain opening or plumbing therein.

The strainer 10 has a wall 20 which is connected to the annular ring 16. As indicated above the wall 20 may provide the strainer with a substantially cylindrical shape or it may be tapered to provide the strainer with a conical or other shape. The wall 20 may be manufactured to fittingly engage a drain 12 or it may merely be suspended in a drain opening.

The wall 20 is also connected to a bottom or strainer surface 22. The ring, 16, wall 20, and bottom surface 22 may all be a solid continuous piece of material or may be distinct elements joined together by mechanical or chemical means as desired. However, As indicated the strainer 10 is flexible in nature and it is preferable that the various elements are a single molded piece of material. As such, the materials from which the strainer 10 may be manufactured from, may include but are not limited to: natural rubber, synthetic rubber, polymeric materials, and polymer-like materials. Such materials may be composed, in whole or in-part, of thermoplastic rubber compounds having a triblock copolymer composition consisting of polymer regions of styrene-rubber-styrene. An example of such material is sold under the name KRATON® available from the GLS corporation. Materials suitable for use in the construction of the strainer preferably have a hardness value, as measured by the Shore A hardness scale, of between about 30–70.

Figure 2:
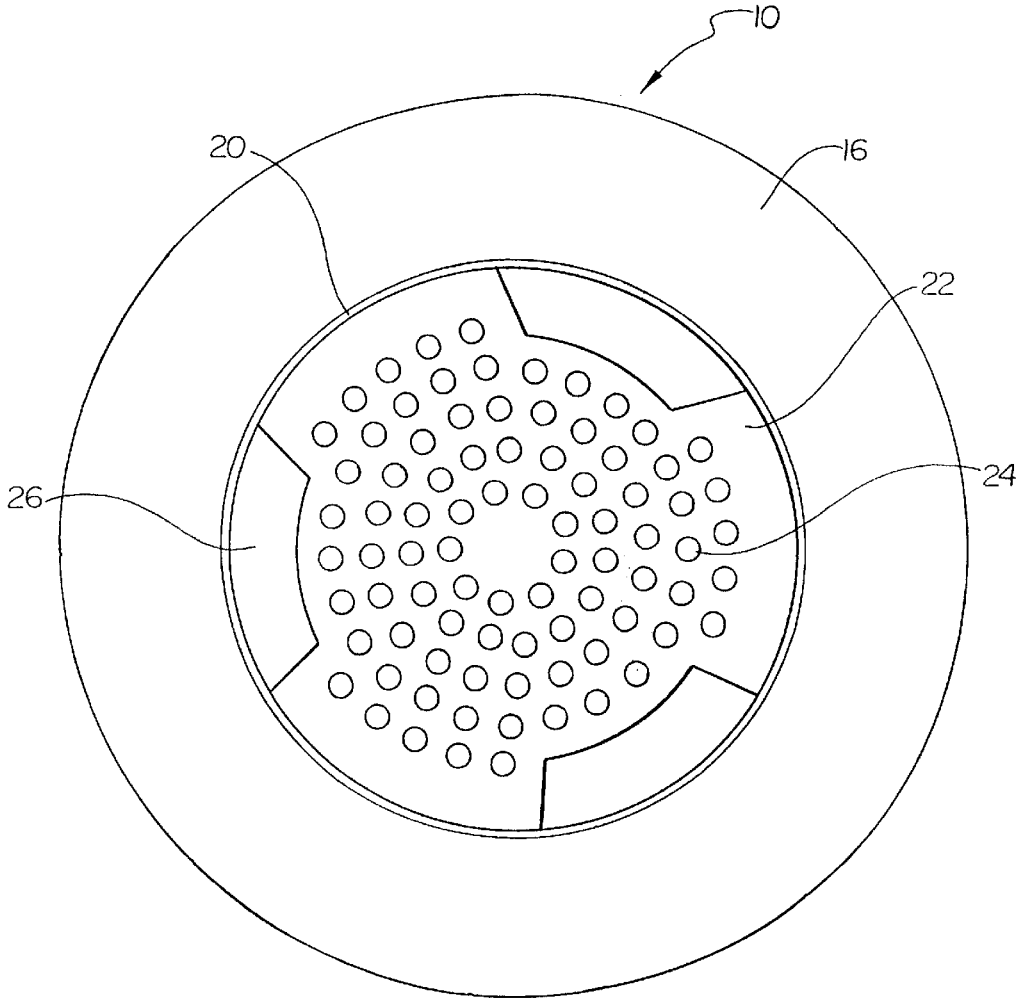
FIG. 2 is a top down view of the strainer shown in FIG. 1.

As may be seen in FIG. 2, the strainer surface 22 is substantially circular in shape and has a plurality of holes 24 therethrough. The holes 24 may be of uniform or varied diameter and may be bored after the manufacture of the strainer 10 or they may be provided for as a result of the molding process. The holes 24 are designed to prevent appropriately sized pieces of matter, namely food, from passing through the strainer surface 22 and into the drain 12. The holes are preferably no larger than ⅛ of an inch (3.175 mm) in diameter but the holes may be provided with substantially any diameter.

As may be seen in FIGS. 1–5 the strainer 10 may be provided with a number of ridges or raised portions 26 relative to the strainer surface 22. The raised portions may be positioned in any manner on the strainer surface 22 but are preferably engaged to the strainer in a uniformly spaced manner about the circumference of the wall 20 as shown. Similarly the ridges may be comprised of any type of water impermeable material, but are preferably composed of the same material as the rest of the strainer and are molded therewith.

Figure 3:
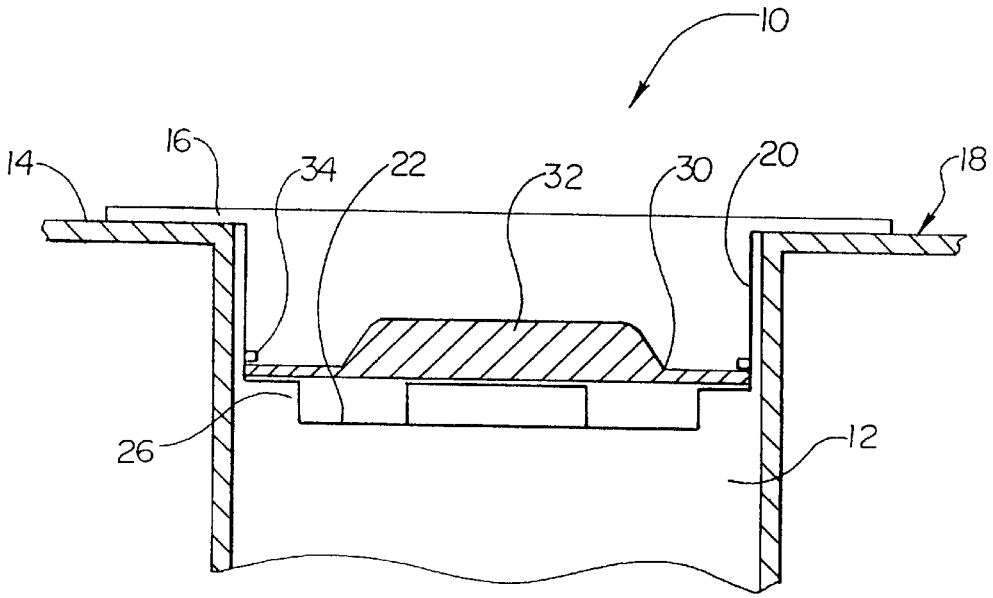
FIG. 3 is a side view of an embodiment of strainer placed in a drain opening with an embodiment of a plug inserted therein.

As may be seen in FIG. 3, the ridges 26 are provided so that when a plug 30 is inserted into the strainer 10, the plug 30 rests upon the ridges 26. In the embodiment shown in FIG. 3 the plug is of sufficient diameter to fittingly engage the wall 20 when positioned on the ridges 26. The plug 30 may be inserted and removed from the strainer 10 by means of protrusion 32. Protrusion 32 provides a gripping surface by which a user may readily manipulate the plug 30.

As with the strainer 10, the plug may be made out of a variety of materials, but if is preferably flexible. As such the plug 30 may be made out of the same materials as the strainer 10, as discussed above.

In the embodiment shown in FIG. 3 an optional ridge seal 34 is shown. The ridge seal 34 is disposed about the circumference of the wall 20 and functions to secure the plug 30 in place and sealingly engage the plug to prevent water seepage between the plug 30 and wall 20. While the ridge seal is not required, any of the embodiments show or described herein may be provided with a ridge seal.

Figure 4:
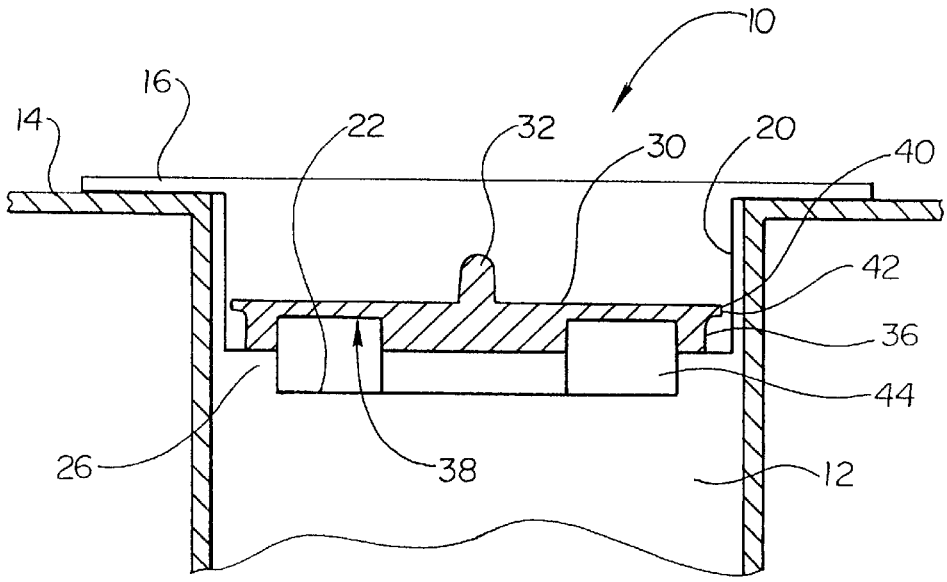
FIG. 4 is a side view of the strainer shown in FIG. 1 with an embodiment of a plug inserted therein for slow drainage.

As may be seen in FIG. 4 an alternative embodiment of the plug 30 is shown. In this embodiment the underside 38 of the plug 30 is equipped with a plurality of downwardly extending legs 36. The legs 36 may be positioned in any manner desired, but should be positioned so as to correspond to the relative position of the ridges 26 located on the strainer surface 22. Preferably the legs 36 and ridges 26 have approximately the same height. In the embodiment shown in FIG. 4, the legs 36 are vertically parallel with the ridges 26. In alternative embodiments the ridges 26 and legs 36 may have different dimensions, such as width, relative to one another.

As may be understood from the embodiments shown in FIG. 4, when the plug 30 is positioned in the strainer 10 in the manner shown, the strainer 10 is provided with a reduced though not ceased water flow. The reduced flow or "slow flow" position of the strainer 10 and plug 30 results from the reduced space or gap 42 between the wall 20 and the lip or rim 40 of the plug. When the plug 30 and strainer 10 are positioned in the manner shown, food particles will be substantially prevented from accumulating on the strainer surface 22 while water remains able to pass therethrough.

In the embodiment of the invention shown in FIG. 4, it should be understood that through rotation of the plug 30 via protrusion 32, the legs 36 of the plug 30 may be repositioned so as to engage the space 44 between the ridges 26 of the strainer.

Figure 5:
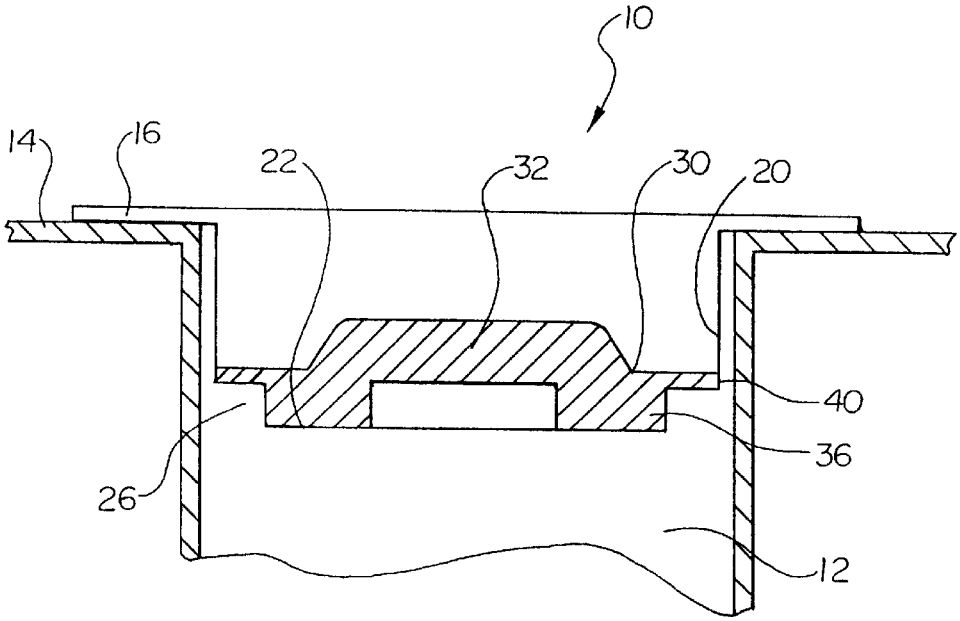
FIG. 5 is a side view of the strainer shown in FIG. 4 wherein the strainer and plug are shown in a closed or no draining configuration.

In the embodiment shown in FIG. 5 the plug 30 may be seen subsequent to the rotation mentioned immediately above. Alternatively, the plug 30 is directly inserted into the strainer 10 in the manner shown so as to provide the strainer with a complete cessation of water flow. As may be seen, the plug 30 may be positioned such that the legs 36 and ridges 26 are allowed to pass by one another. When the plug 30 is positioned so as to stop water flow, preferably legs 36 and ridges 26 adjacently engage one another. When the plug is positioned in the manner shown in FIG. 5, the plug rim 40 will fitingly engage the wall 20. The engagement of the wall 20 and rim 40, as well as the immediate adjacency of the ridges 26 and legs 36, provides a water tight seal between the strainer 10 and plug 30. As a result, when the plug 30 is positioned within the strainer 10 in the manner shown, the holes, shown in FIG. 2, may be sealed.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A flexible removable strainer for use in conjunction with a drain opening of a plumbing fixture, the strainer comprising:

a substantially cylindrical portion constructed and arranged to extendingly and removably engage the drain opening;

a bottom portion engaged to a lowermost portion of the substantially cylindrical portion, the bottom portion having a plurality of openings therethrough, the bottom portion further comprising a plurality of ridges, the plurality of ridges extending upwardly from the bottom portion, each of the plurality of ridges having a top surface and a length, each of the top surfaces having the same height above the bottom portion along the length of the ridge;

an annular ring engaged to an uppermost portion of the substantially cylindrical portion and outwardly extending therefrom, the annular ring constructed and arranged to form a seal with a portion of the plumbing fixture immediately adjacent to the drain opening; and a plug constructed and arranged to be placed within and to removably and fittingly engage the substantially cylindrical portion of the strainer, the plug further comprising a plurality of legs integral with a lower surface of the plug and extending downwardly therefrom.

2. The flexible strainer of claim 1 wherein the annular ring supports the substantially cylindrical portion when the substantially cylindrical portion is engaged to the drain opening.

3. The flexible strainer of claim 1 wherein the annular portion forms an angle of about 90 degrees with the substantially cylindrical portion.

4. The flexible strainer of claim 1 wherein the annular portion extends approximately 1 inch from the substantially cylindrical portion.

5. The flexible strainer of claim 1, the lower surface constructed and arranged to be removably engaged to the bottom portion.

6. The flexible stainer of claim 5, the lower surface of the plug further constructed and arranged to sealingly engage the plurality of openings when the plug is engaged to the bottom portion.

7. The flexible stainer of claim 1 wherein the plug further comprises an upper surface, the upper surface having at least one projection, the at least one projection providing a grasping surface by which the plug may be removed from within the substantially cylindrically shaped portion.

8. The flexible strainer of wherein 1 the plurality of ridges are constructed and arranged to engage at least a portion of the lower surface of the plug when the plug is placed within the substantially cylindrical portion.

9. The flexible strainer of claim 1 wherein the plurality of legs are constructed and arranged to engage at least a portion of the bottom portion when the plug is placed within the substantially cylindrical portion.

10. The flexible strainer of claim 1 wherein when the plug is placed within the substantially cylindrical portion, the plurality of ridges and the plurality of legs are immediately adjacent to one another, thereby providing a substantially water tight seal between the lower surface of the plug and the bottom portion.

11. The flexible strainer of claim 1 wherein when the plug is placed within the substantially cylindrical portion, the plug being movable between a first position to a second position, in the first position the plurality of ridges being supportingly engaged to the plurality of legs, in the second position the plurality of ridges and the plurality of legs being immediately adjacent to one another so as to provide a water tight seal between the lower surface of the plug and the bottom portion.

12. The flexible strainer of claim 11, wherein the plug is constructed and arranged to be rotated to move between the first position and the second position.

13. The flexible strainer of claim 11 wherein when the plug is in the first position the plurality of ridges and the plurality of legs are in substantial vertical alignment.

14. The flexible strainer of claim 1 wherein the strainer is manufactured from at least one member of the group consisting of: natural rubber, synthetic rubber, polymeric materials, polymer-like materials and any combinations thereof.

15. The flexible strainer of claim 1 wherein the plumbing fixture is a kitchen sink.

* * * * *